United States Patent [19]

Oksuzler

[11] Patent Number: 4,690,586

[45] Date of Patent: Sep. 1, 1987

[54] METHOD AND APPARATUS FOR POSITIONING AN OFFSHORE PLATFORM JACKET

[75] Inventor: Yalcin Oksuzler, Plano, Tex.

[73] Assignee: Mobil Oil Corporation, New York, N.Y.

[21] Appl. No.: 814,958

[22] Filed: Dec. 31, 1985

[51] Int. Cl.[4] ..... E02D 25/00

[52] U.S. Cl. ..... 405/209; 405/205; 405/203

[58] Field of Search ..... 405/203, 205, 209, 204, 405/207, 208

[56] References Cited

U.S. PATENT DOCUMENTS

| | | | |
|---|---|---|---|
| 3,633,369 | 1/1972 | Lawrence | 405/209 |
| 3,823,564 | 7/1974 | Crout et al. | 405/209 |
| 4,112,697 | 9/1978 | Chow . | |
| 4,135,842 | 10/1979 | Blight et al. | 405/209 |
| 4,161,376 | 7/1979 | Armstrong | 405/204 |
| 4,260,291 | 4/1981 | Young et al. | 405/203 |
| 4,293,240 | 10/1981 | Ogimoto et al. | 405/203 |
| 4,556,342 | 12/1985 | Tannahill | 405/203 |
| 4,629,365 | 12/1986 | Kuriiwa | 405/228 |

FOREIGN PATENT DOCUMENTS 980575 1/1965 United Kingdom .

*Primary Examiner*—Cornelius J. Husar
*Assistant Examiner*—Kristina I. Hall
*Attorney, Agent, or Firm*—Alexander J. McKillop; Michael G. Gilman; Charles J. Speciale

[57] ABSTRACT

A method for positioning an offshore platform jacket is used wherein the jacket is loaded on a barge in a conventional manner and towed out to sea to a predetermined offshore location. The barge is submerged, and the buoyant jacket is detacted. The jacket is towed away, and the barge is resurfaced for additional use.

2 Claims, 13 Drawing Figures

METHOD AND APPARATUS FOR POSITIONING AN OFFSHORE PLATFORM JACKET

BACKGROUND OF THE INVENTION

An offshore platform used in the production of hydrocarbons is constructed in several phases. Portions of the offshore platform are manufactured onshore and assembled either in close proximity to the place of manufacture or at the location where the offshore platform is to be positioned for production. One portion of an offshore platform that is manufactured onshore and towed to the location where the offshore platform is to be positioned is the jacket. An offshore platform jacket is normally fabricated in a yard adjacent to a slipway. After fabrication, it is skidded onto launch beams, first over the skid beams 14 on dock, then over the skid beams 16 on a launch barge. The barge is then towed out to sea by a tugboat 20. Subsequent to the ocean tow, it is launched into the sea over tilting (rocker) beams 22, located at the end of the skid beams (see FIGS. 1–4).

A great majority of shallow water jackets (those that cannot be lifted off because of weight limitations) and all of deep-water jackets follow this routine before they are finally upended, piled and their deck installed.

During the launching operation, both jacket and barge usually undergo one of the highest stress levels. Approximately ten (10%) percent by weight of additional steel is required in many jackets in order to resist the one-time severe launching stresses. This additional steel, which is not needed except for launching, becomes part of the permanent structure and attracts additional wave and current loads throughout the life of the structure.

Generally, the strength of the launch barge is also tested during launching. The barges are heavily reinforced around the tilting beam supports. One jacket may deliver up to twenty thousand (20,000) tons of load onto each pin of the rocker beams.

SUMMARY OF THE INVENTION invention provides a method for positioning an offshore platform jacket which avoids the concentration of stress to a few points and minimizes the mechanical stress to which the barge used to tow the platform jacket to its offshore location is subjected. The method of the present invention eliminates the expensive, sometimes dangerous, highly stressed conditions of jackets and barges. By using the present invention, a launch barge will tow the jacket to its offshore location. The barge is then submerged, and the jacket is detached. The barge is completely submerged, and the jacket is towed away. The barge is resurfaced for additional uses. By avoiding unloading stresses, the size and weight of the jacket may be reduced to a size and weight necessary for platform use.

DESCRIPTION OF THE PREFERRED EMBODIMENT

The present invention discloses a method for unloading a jacket used in an offshore platform without the high stress loads currently associated with launching a jacket from a launch barge.

Figure 1A:
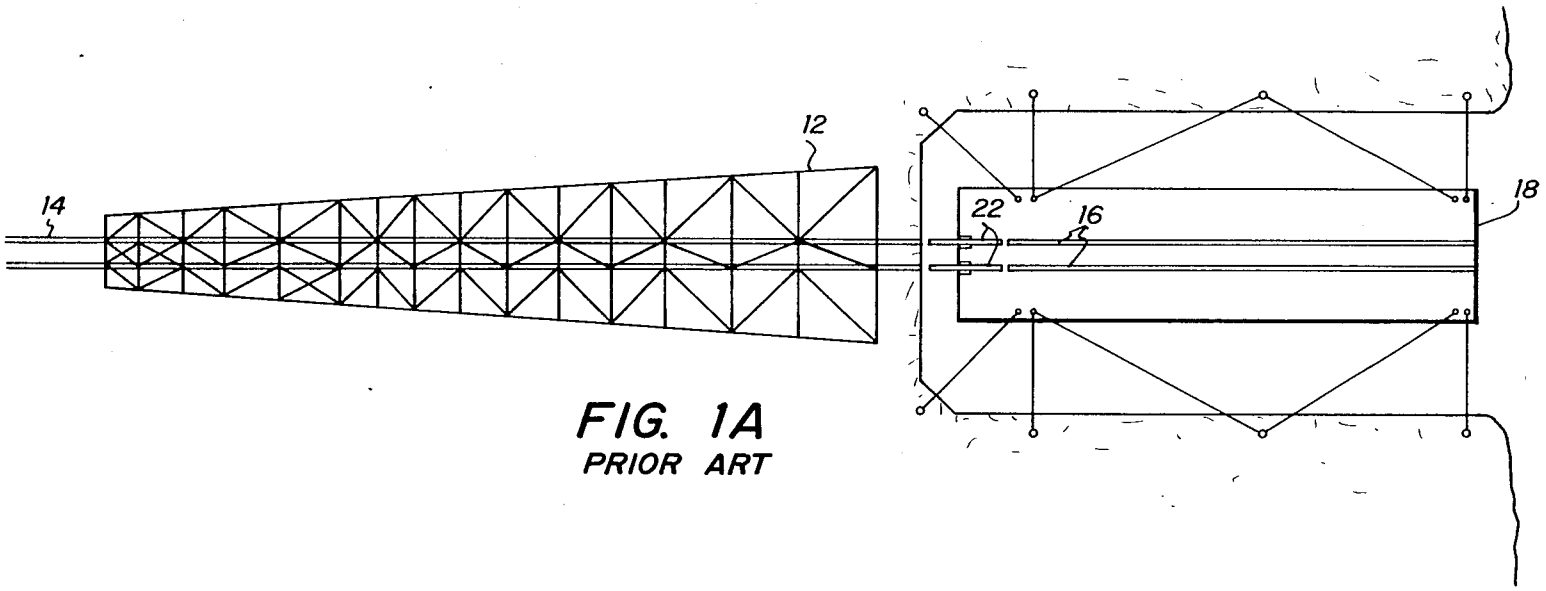
FIG. 1A PRIOR ART
FIG. 1A illustrates a plan view of loading a jacket onto a launch barge.
Figure 1B:
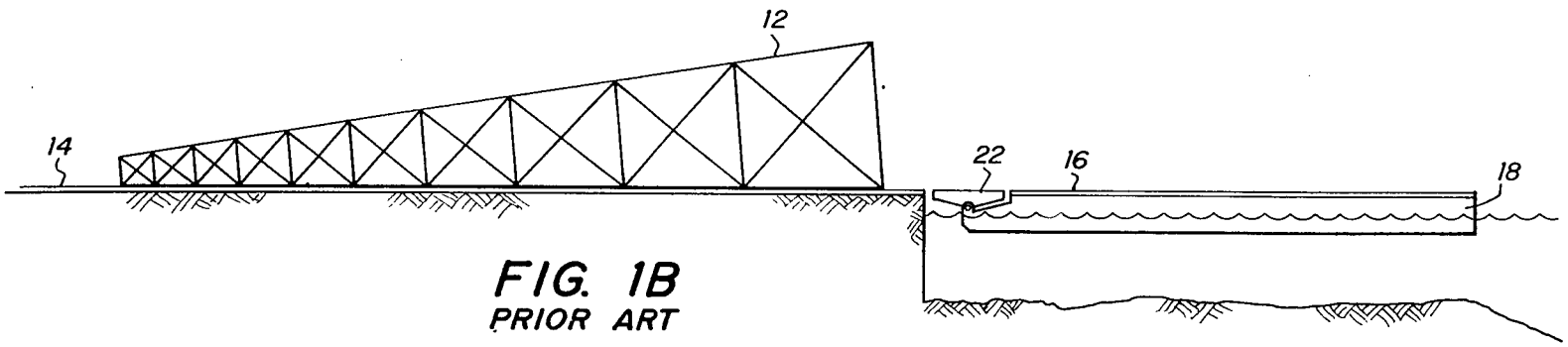
FIG. 1B PRIOR ART
FIG. 1B is an elevational view of FIG. 1.
Figure 2:
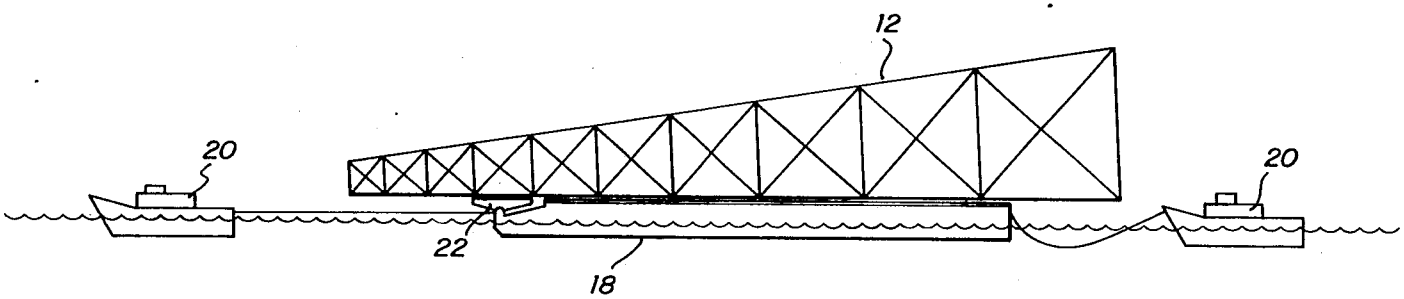
FIG. 2 PRIOR ART
FIG. 2 illustrates a launch barge with a jacket thereon.
Figure 4A:
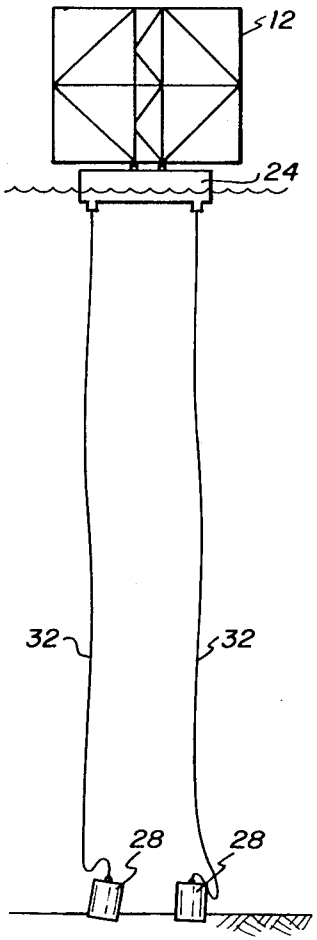
FIG. 4A is a rear view of FIG. 4.
Figure 4:
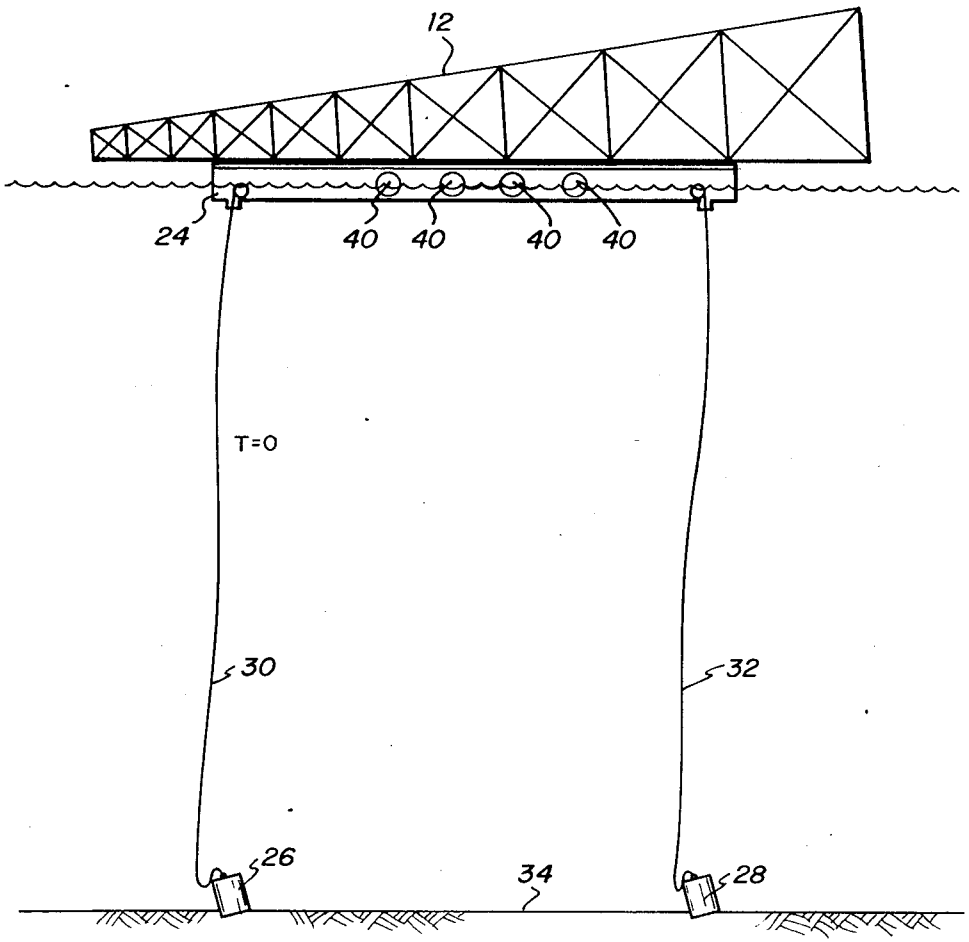
FIG. 4 illustrates a launch barge with a jacket thereon anchored to the ocean floor.

Referring now to FIG. 4, jacket 12 may be loaded onto a barge 24 in any conventional manner, such as that described in conjunction with FIGS. 1 and 2. Cargo barge 24 illustrated in FIG. 4 is called a Tension Leg Barge (TLB), and it is equipped with cables and anchors to facilitate controlled submergence of a loaded barge. Tension Leg Barge 24 is illustrated as connected to anchors 26 and 28 through cables 30 and 32, respectively. Although Tension Leg Barge 24 is anchored to the ocean floor 34 through anchors 26 and 28, it is to be understood that additional methods of anchoring barge 24 are also possible in the scope of the present invention. For example, anchor piles may be driven into the ocean floor ahead of time, or anchors, instead of being lowered from the Tension Leg Barge, can be dropped to the ocean floor, also ahead of time. In addition, the Tension Leg Barge may be grounded on a submerged island, if so desired.

Figure 5A:
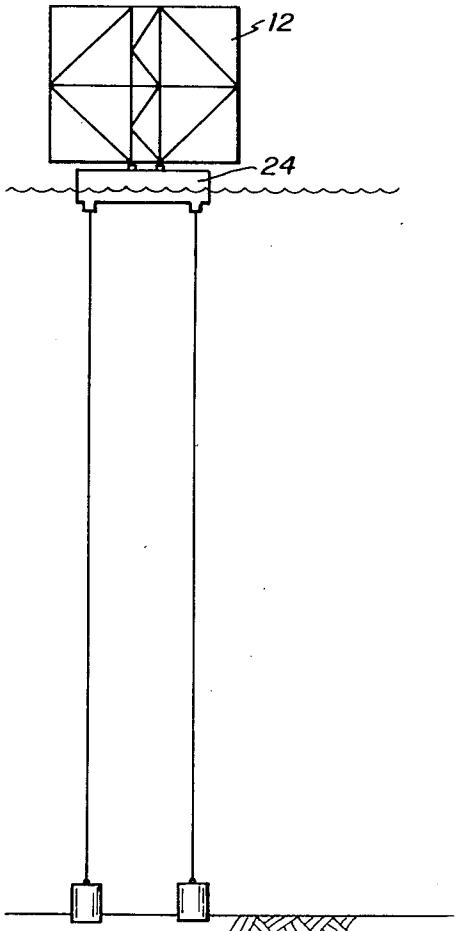
FIG. 5A is a rear view of FIG. 5.
Figure 5:
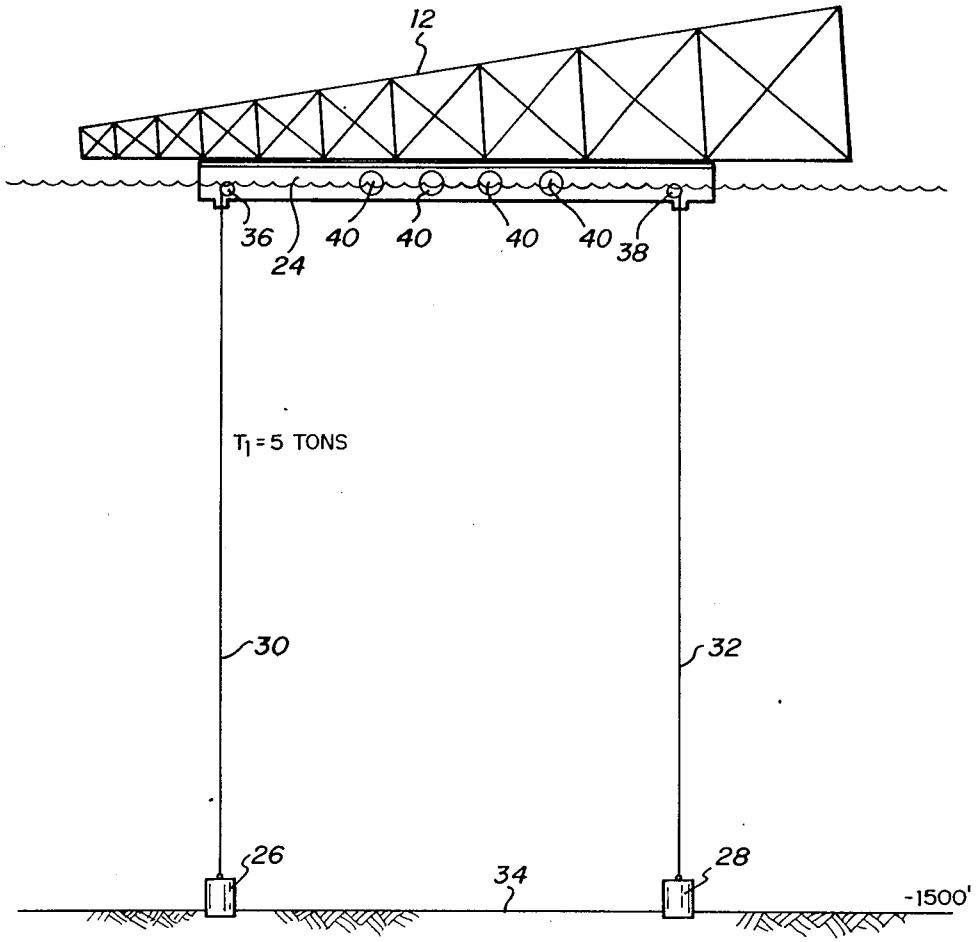
FIG. 5 illustrates the barge of FIG. 4 with the anchors in tension.

FIG. 5 illustrates the arrangement of FIG. 4 with cables 30 and 32 drawn taut to partially submerge barge 24. Cables may be drawn taut by winches or the like located at points 36 and 38 on barge 24. At this point, the tension on cables 30 and 32 is approximately five tons.

Figure 6A:
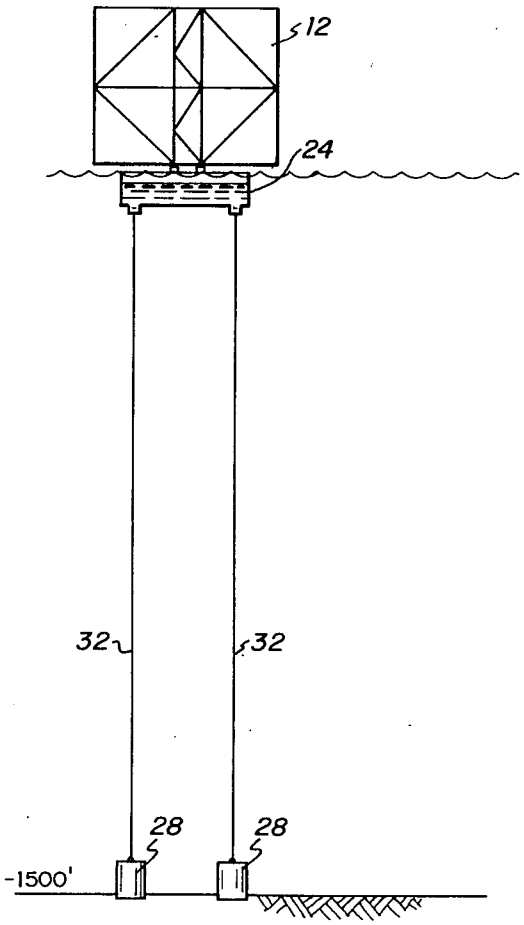
FIG. 6A is a rear view of FIG. 6.
Figure 6:
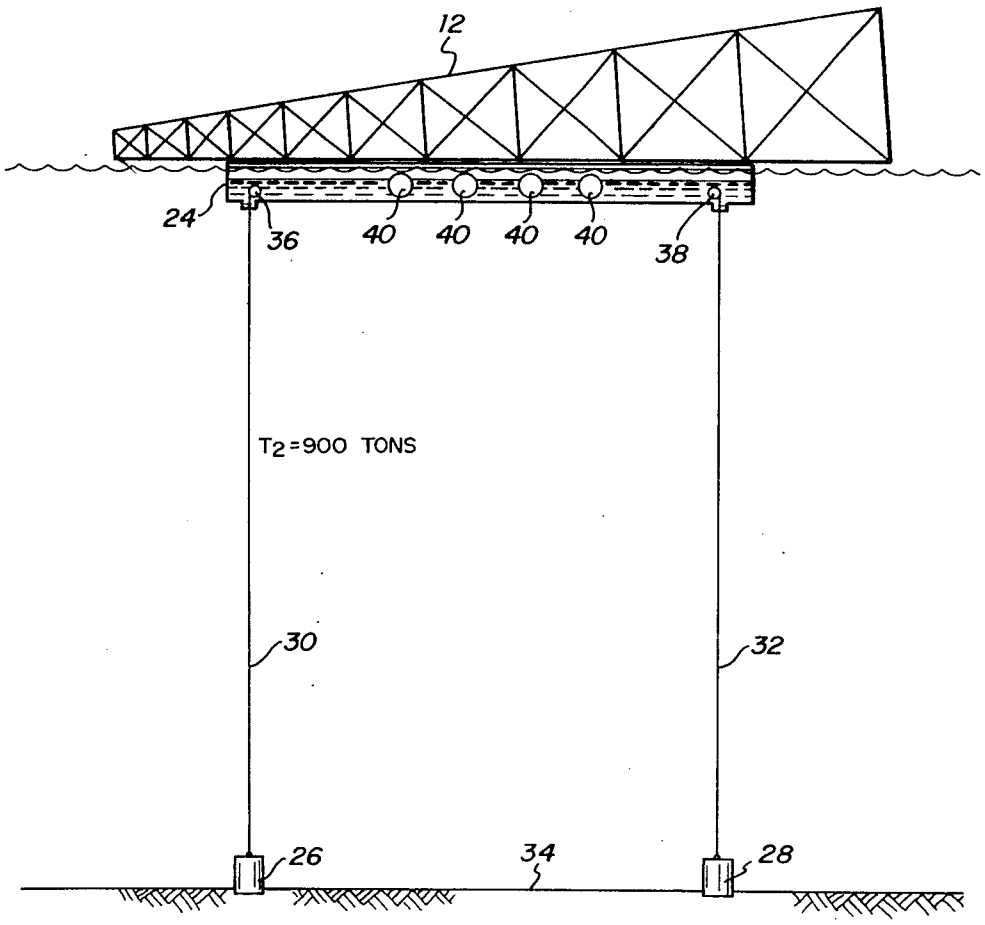
FIG. 6 illustrates the barge of FIG. 5 partially submerged.

Referring now to FIG. 6, the tension is increased on cables 30 and 32 to approximately 900 tons while barge 24 is being partially flooded to continue with a controlled submergence. Contained on barge 24 are buoyancy tanks 40 which are used to keep the barge slightly buoyant.

Figure 7:
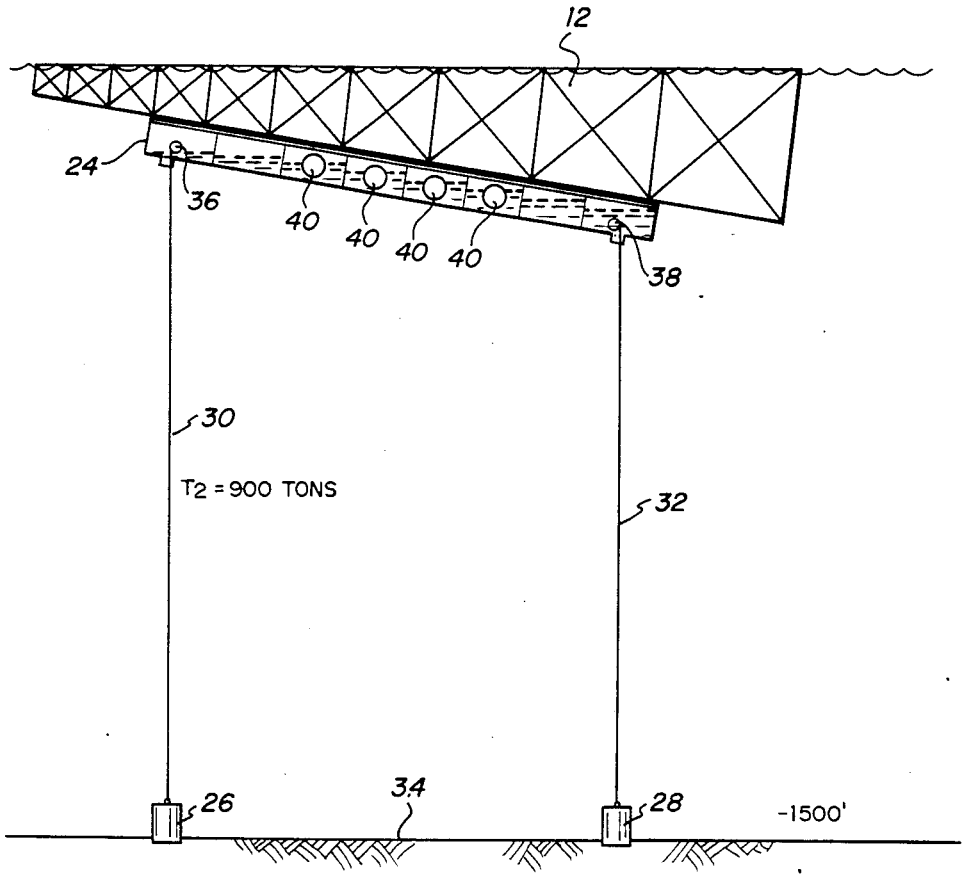
FIG. 7 illustrates the barge of FIG. 6 completely submerged.
Figure 8:
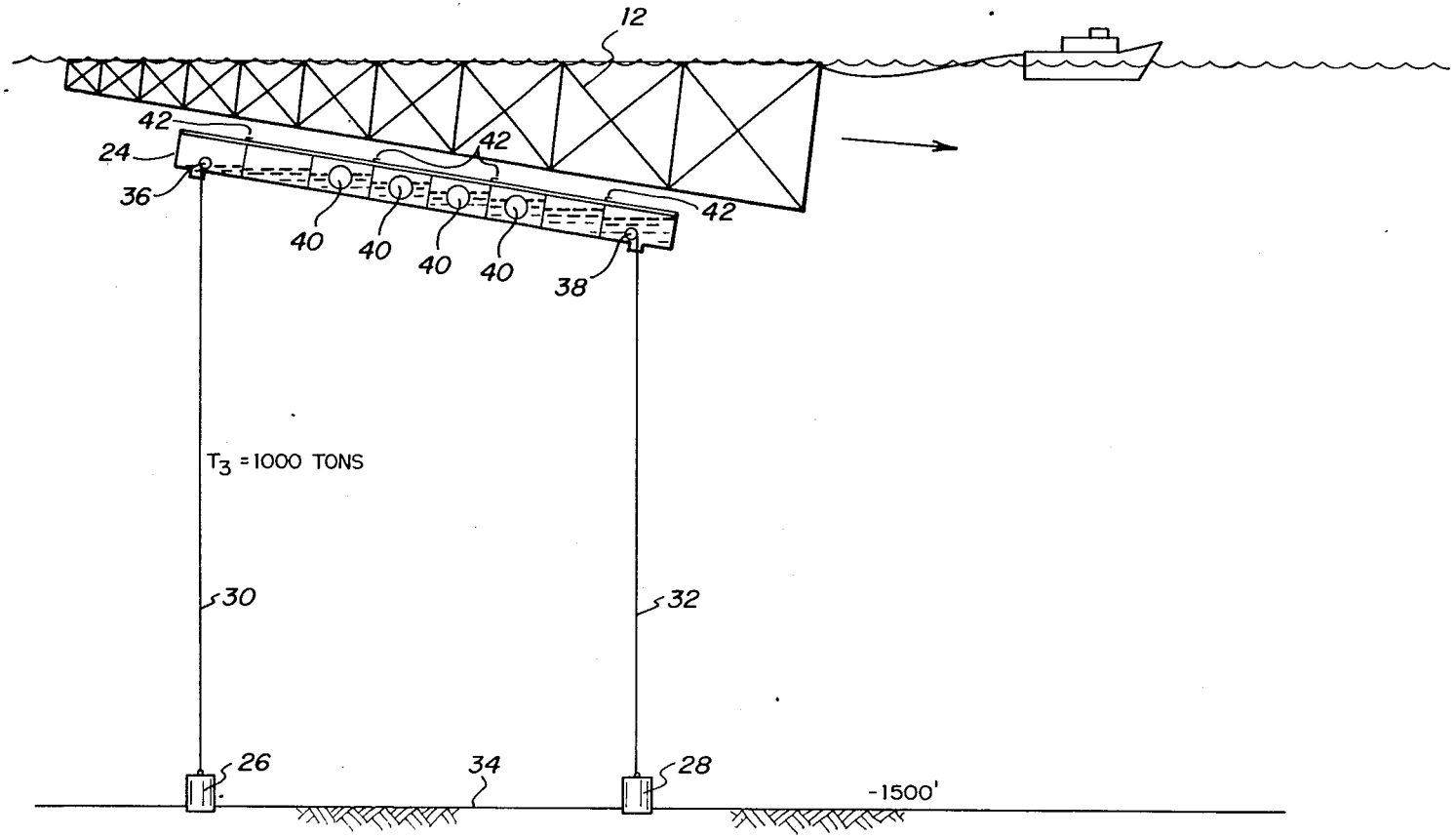
FIG. 8 illustrates the barge of FIG. 7 with the jacket detached.

As illustrated in FIG. 7, the controlled flooding and cable tensioning continues until the upper legs of jacket 12 are substantially submerged. At this point, barge 24 is fully flooded except for the high-pressure buoyancy tanks 40, which keep the barge slightly buoyant. Jacket 12 is completely weightless or buoyant. FIG. 8 illustrates jacket 12 as being released from barge 24 as quick release hooks 42 are disconnected. Jacket 12 may then be towed away by tug 20 while barge 24 is submerged. Barge 24 may be pulled further away from jacket 12 by increasing the tension on cables 30 and 32 to approximately 1,000 tons.

Figure 9:
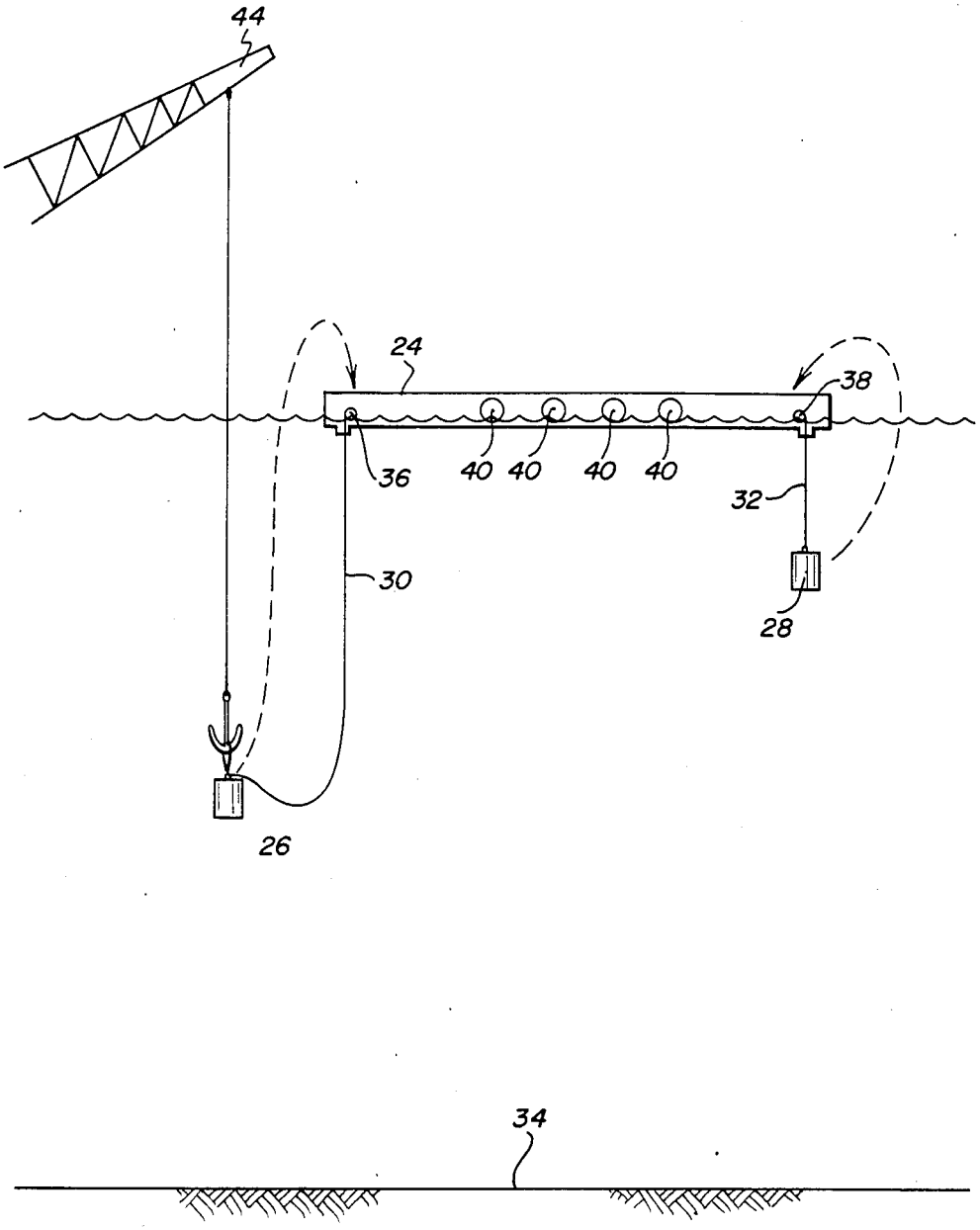
FIG. 9 illustrates the barge of FIG. 8 with the jacket towed away.

FIG. 9 illustrates barge 24 after jacket 12 has been towed away. Anchors 26 and 28 may be loaded on barge 24 by being pulled up from ocean floor 34 by derrick 44. At this point, all the water has been pumped out of barge 24, and it is again floating on the surface.

Figure 3:
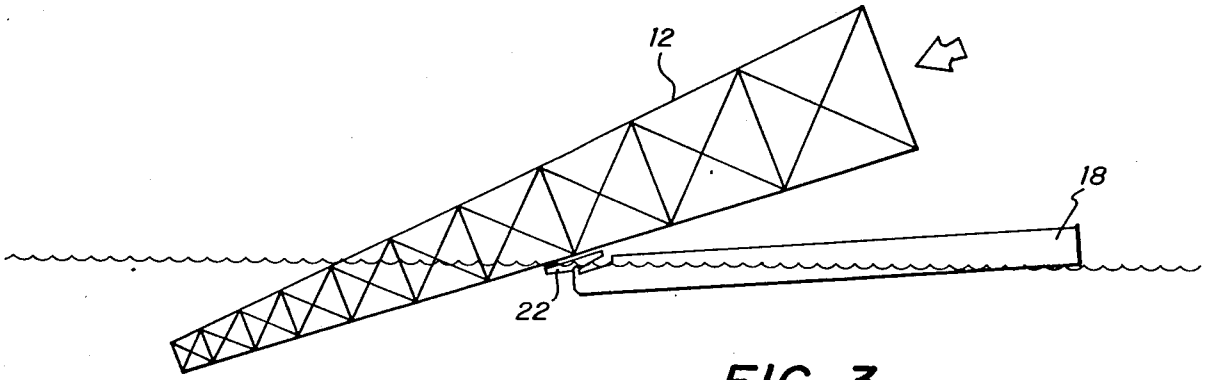
FIG. 3 PRIOR ART
FIG. 3 illustrates a prior art method for unloading a jacket from a launch barge.

Using the method of the present invention, jacket 12 may be designed so that it is lighter and less expensive. Furthermore, jacket 12 will not be subjected to the high levels of stress due to the conventional launching of jacket 12 from a launch barge 18, such as depicted in FIG. 3. Furthermore, Tension Leg Barge 24 also will not be subjected to the high launching stresses that launch barge 18 was subjected. As a result, barge 24 shall not need to undergo thorough substantial reinforcement every time a jacket is to be launched. Furthermore, barge 24 can be used to facilitate the deinstallation of existing platforms when time comes for their abandonment.

While the present invention has been described by way of preferred embodiment, it is to be understood as not being limited thereto, but only by the scope of the following claims.

I claim:

1. A method of positioning an offshore platform jacket comprising the steps of:

loading and securing the platform jacket onto a tension leg barge;

towing said tension leg barge to a predetermined offshore location;

laying anchors on the floor of the ocean at said predetermined offshore location;

attaching lines between said anchors and said tension leg barge to position and maintain said barge above said predetermined offshore location;

partially submerging said tension leg barge by shortening said lines between said anchors and said tension leg barge;

completing the submerging of said tension leg barge by flooding said barge with seawater; and releasing said platform jacket from said tension leg barge and towing said jacket off said barge while said barge is submerged.

2. The method of claim 1 including:

pumping said seawater from said tension leg barge once said platfrom jacket has been towed therefrom to resurface said barge; and removing said lines between said anchors and said tension leg barge.

* * * * *